US005871596A

United States Patent [19]

Kiefer et al.

[11] Patent Number: 5,871,596

[45] Date of Patent: Feb. 16, 1999

[54] APPARATUS AND METHOD FOR COOLING HOT ROLLED STEEL ROD

[75] Inventors: Bruce V. Kiefer; Philip J. Brain, both of Holden; Pieter L. Keyzer, Worcester, all of Mass.

[73] Assignee: Morgan Construction Company, Worcester, Mass.

[21] Appl. No.: 838,512

[22] Filed: Apr. 8, 1997

[51] Int. Cl.[6] ..... C21D 9/573

[52] U.S. Cl. ..... 148/601; 266/111; 266/106

[58] Field of Search ..... 266/103, 106, 266/111; 72/201; 148/601

[56] References Cited

U.S. PATENT DOCUMENTS

| | | | |
|---|---|---|---|
| 3,390,871 | 7/1968 | McLean et al. . | |
| 3,522,936 | 8/1970 | Geipel et al. . | |
| 3,832,788 | 9/1974 | Kato et al. . | |
| 4,023,392 | 5/1977 | Fujita et al. | 72/201 |
| 4,090,697 | 5/1978 | Perrine . | |
| 4,375,884 | 3/1983 | Grotepass | 266/106 |
| 4,423,856 | 1/1984 | Takahashi et al. . | |
| 5,121,902 | 6/1992 | Jalil et al. . | |
| 5,196,156 | 3/1993 | Gage et al. | 266/106 |
| 5,299,783 | 4/1994 | Ledger et al. . | |

FOREIGN PATENT DOCUMENTS

| | | |
|---|---|---|
| 0359279A1 | 9/1989 | European Pat. Off. . |
| 0516502A1 | 5/1992 | European Pat. Off. . |
| 0216434SA1 | 9/1996 | European Pat. Off. . |
| 2297679 | 1/1976 | France . |

*Primary Examiner*—Scott Kastler
*Attorney, Agent, or Firm*—Samuels, Gauthier & Stevens

[57] ABSTRACT

A laying head forms hot rolled steel rod into a continuous series of rings. The rings are received on a conveyor for transport in an overlapping pattern through at least one cooling zone. The ring density of the overlapping pattern is greater along edge regions of the conveyor as compared to the ring density at a central region of the conveyor. A gaseous coolant is directed upwardly through the overlapping ring pattern, and a screen or other like foraminous element retards the upward flow of gaseous coolant at the central region of the conveyor.

8 Claims, 4 Drawing Sheets

APPARATUS AND METHOD FOR COOLING HOT ROLLED STEEL ROD

BACKGROUND OF THE INVENTION

1. Field of the Invention

This invention relates to rolling mills, and is concerned in particular with an improvement in the apparatus and methods employed to subject hot rolled steel rod to controlled cooling in order to achieve optimum metallurgical properties.

2. Description of the Prior Art

In a conventional rolling mill installation, as depicted in FIG. 1, hot rolled steel rod 10 emerges from the last roll stand 12 of the mill at a temperature of about 750°–1100° C. The rod is then rapidly water-quenched down to about 550°–1000° C. in a series of water boxes 14 before being directed by driven pinch rolls 16 to a laying head 18. The laying head forms the rod into a continuous series of rings 20 which are deposited on a cooling conveyor generally indicated at 22. The conveyor has driven table rollers 24 which carry the rings in a non-concentric overlapping pattern through one or more cooling zones. The conveyor has a deck 26 underlying the rollers 24. The deck is interrupted by slots or nozzles 28 through which a gaseous cooling medium, typically ambient air, is directed upwardly between the rollers 24 and through the rings being transported thereon. The cooling air is driven by fans 30 connected to the nozzles 28 via plenum chambers 32. The thus cooled rings drop from the delivery end of the conveyor into a reforming chamber 34 where they are gathered into upstanding coils.

As can best be seen in FIG. 2, the non-concentric overlapping ring pattern has a greater density along edge regions 36 of the conveyor as compared to the density at a central region 38 of the conveyor. Therefore, a greater amount of air is directed to the edge regions 36 of the conveyor to compensate for the greater density of metal at those regions. Typically, this is achieved by increasing the nozzle or slot area at the edge regions. As illustrated in FIG. 2, this can be accomplished by locating short slots or nozzles 28*a* at the edge regions 36 between longer slots or nozzles 28*b* which extend across the full conveyor width. Alternatively, full width nozzles or slots may be employed exclusively in conjunction with mechanical means such as vanes, dampers, etc. (not shown) in the plenum chambers to direct more air to the conveyor edge regions 36.

The cooling path through metallurgical transformation is a function of the air velocity and the amount of air (among other factors) applied to the rod. Thus, as the rod is conveyed by the table rollers 24 over successive mutually spaced slots or nozzles 28, the resulting intervals between coolant applications produce a stepped cooling path as shown in FIG. 3.

As shown in FIG. 4, with a greater number of coolant applications at the edge regions 36 as compared to the central region 38, the non uniform intervals between successive coolant applications will result in one cooling path $P_{36}$ at the edge regions 36 and a different cooling path $P_{38}$ at the central region 38. These different cooling paths cause different rod segments to pass through transformation at different temperatures and at different rates, resulting in non-uniform metallurgical properties along the length the rod.

A related disadvantage of conventional air distribution systems is the "hard" transition from high air velocities at the conveyor edge regions 36 to lower air velocities at the central region 38. Where different numbers of nozzles are located at the edge and central conveyor regions as illustrated in FIG. 2, the edge nozzles 28*a* supply air only over a discrete portion of the total width of the steel rings being cooled. There is a sudden change from intense air cooling to no air cooling at the transition between the edge and the central regions. In the case of nozzles which span the entire width of the conveyor as used in conjunction with vanes or dampers to direct more flow to the edges, there is also a "hard" transition from high flow at the edges to lower flow in the center. This is a result of the presence of dividers in the plenum chamber upstream of the nozzles, which channel the air from the fans to the nozzles.

The objective of the present invention is to avoid the above-described drawbacks of conventional air distribution systems by applying cooling air to all ring segments at regularly spaced intervals, coupled with a decrease in the air flow rate at the central region of the conveyor, where ring density is lower than that at the conveyor edge regions.

A companion objective of the present invention is the elimination of hard transitions from high air velocities at the conveyor edge regions to low air velocities at the conveyor central region.

SUMMARY OF THE INVENTION

In accordance with the present invention, hot rolled steel rod is directed to a laying head where it is formed into a continuous series of rings. The rings are deposited on a conveyor in an overlapping pattern with successive rings being offset one from the other in the direction of conveyor movement, resulting in the density of the rod being greater along edge regions of the conveyor as compared to the rod density at a central region of a conveyor. Cooling air is directed upwardly through the rings. A perforated element is arranged beneath the path of ring travel along the central region of the conveyor to retard the upward flow of air at the central conveyor region and to direct air preferentially to the edge regions of the conveyor. The more densely packed rod at the edge regions of the conveyor benefits from this increased air flow and thereby cools through transformation at approximately the same rate as at the central conveyor region.

BRIEF DESCRIPTION OF THE DRAWINGS

Preferred embodiments of the invention will now be described in greater detail with reference to the accompanying drawings, wherein.

DETAILED DESCRIPTION OF THE ILLUSTRATED EMBODIMENTS

Figure 1:
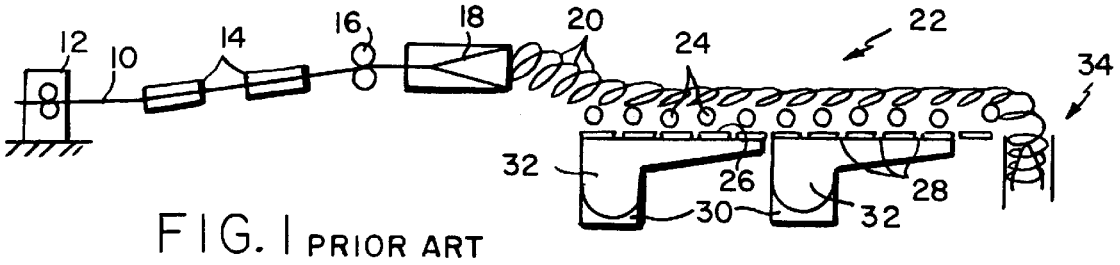
FIG. 1 PRIOR ART
FIG. 1 is a diagrammatic illustration of a conventional rolling mill installation.
Figure 2:
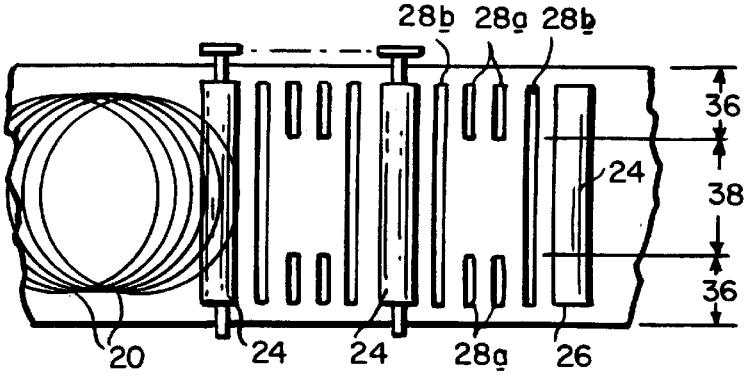
FIG. 2 PRIOR ART
FIG. 2 is a plan view of a portion of the cooling conveyor shown in FIG. 1.
Figure 3:
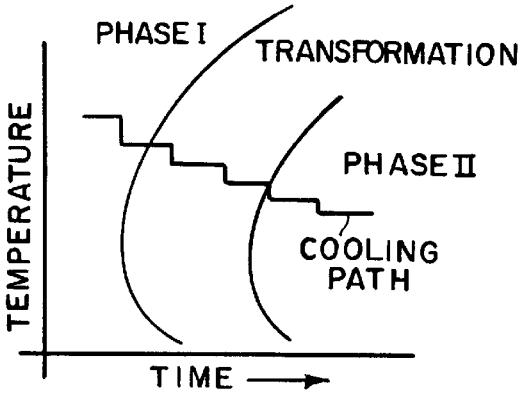
FIG. 3 PRIOR ART
FIG. 3 is a graph showing a conventional cooling path.
Figure 4:
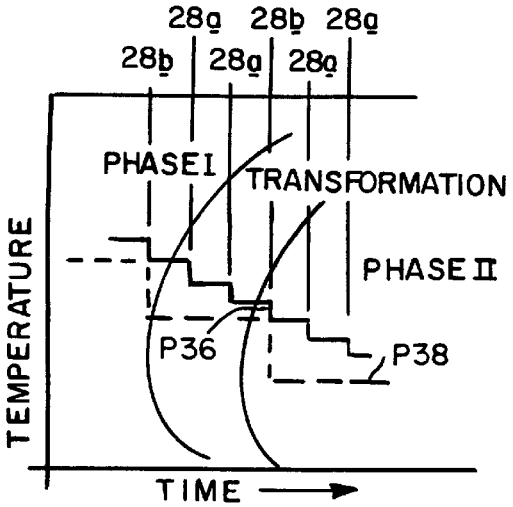
FIG. 4 PRIOR ART
FIG. 4 is another graph showing the cooling paths experienced by rod segments being processed on the conveyor shown in FIG. 2.
Figure 5:
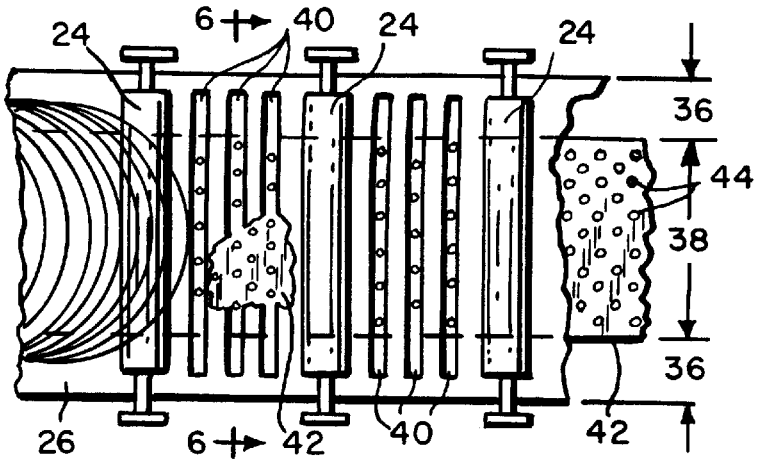
FIG. 5 is a plan view with portions broken away of a portion of a cooling conveyor in accordance with the present invention.
Figure 6:
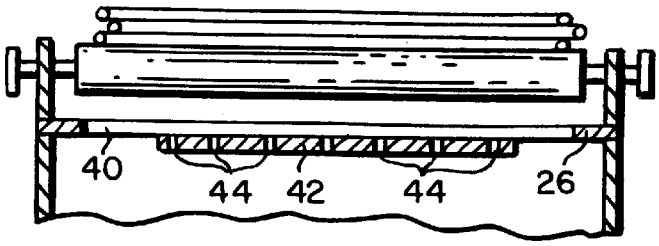
FIG. 6 is a sectional view taken along line 6—6 of FIG. 5.

In accordance with the present invention, and as illustrated in FIGS. 5 and 6, the conveyor deck 26 is interrupted by evenly spaced slots or nozzles 40 which extend continuously across both the edge regions 36 and the central region 38. A perforated planar element 42 extends along the central region 38 beneath the conveyor deck 26.

Figure 7:
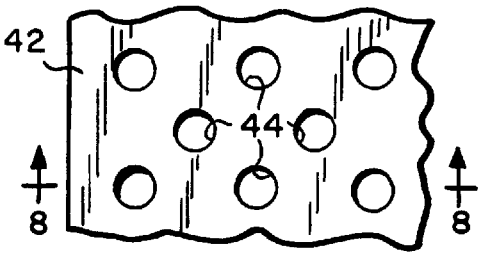
FIG. 7 is an enlarged partial plan view of the perforated air distribution element shown in FIGS. 5 and 6.
Figure 8:
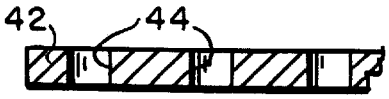
FIG. 8 is a sectional view taken along line 8—8 of FIG. 7.
Figure 9:
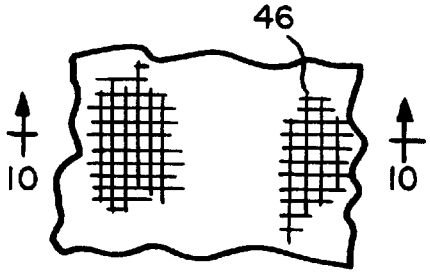
FIG. 9 is a partial plan view of a wire mesh air distribution element.
Figure 10:
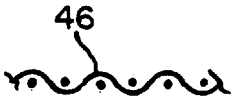
FIG. 10 is a sectional view taken along line 10—10 of FIG. 9.

As shown in FIGS. 7 and 8, perforated element 42 may consist, for example, of a metal plate having a thickness of 1–25 mm with an array of drilled or stamped holes 44 providing 5–90% open area. Alternatively, as shown in FIGS. 9 and 10, the perforated element may comprise a wire mesh 46, or any other foraminous structure capable of retarding the upward flow of air through the slots 40 at the central region 38 of the conveyor.

Figure 11:
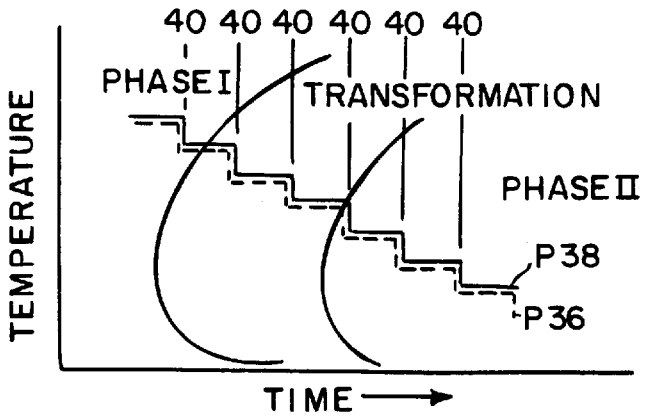
FIG. 11 is a graph depicting the cooling paths of rod rings being processed on the conveyor shown in FIGS. 5 and 6.

By employing a perforated plate 42, wire mesh 46 or the like at the central region 38 of the conveyor, air flow through the regularly spaced slots or nozzles 40 is redistributed to provide the additional cooling required at the conveyor edge regions, while insuring that rod segments at both the edge and central regions experience the same intervals between successive coolant applications. Thus, as shown in FIG. 11, the cooling paths $P_{36}$ and $P_{38}$ at the edge and central regions 36, 38 will be substantially identical, which in turn will produce more uniform metallurgical properties along the entire length of the rod.

The implementation of a perforated air distribution plate or wire mesh has advantages for (a) systems with nozzles which channel the air directly through the rings being cooled, the air moving principally in a direction perpendicular to the direction of travel of the rings along the conveyor; and (b) systems with "angled" nozzles, which typically extend between the rollers, closer to the rod rings and which direct the air at an angle from the vertical, in order to increase contact time with the material being cooled. In both cases, the perforated plate or wire mesh helps insure that both the center and edges experience the same number of regularly spaced coolant applications as discussed above. In the case of the angled nozzles, which provide a higher rate of cooling, it is more important to have the rod at the edge and central conveyor regions follow the same cooling path, since the metallurgical property differences resulting from transformation at different times and temperatures become more pronounced as the cooling rate is increased.

Figure 12:
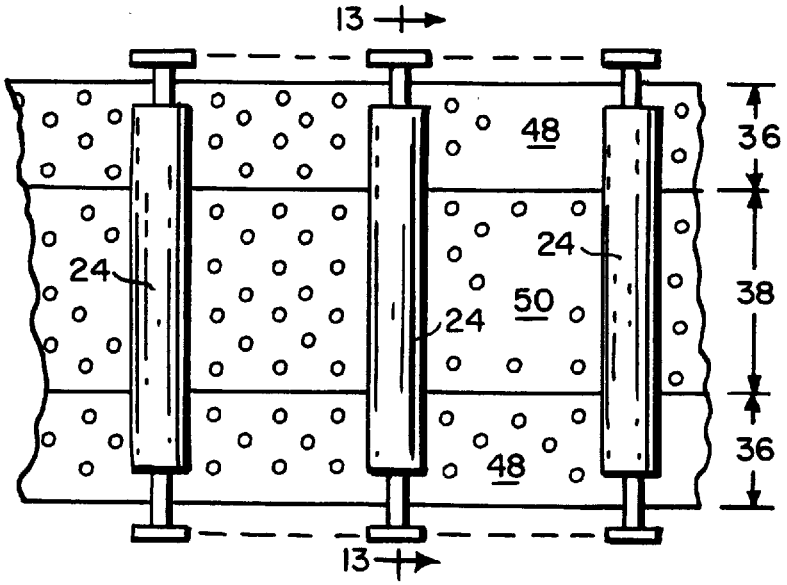
FIG. 12 is partial plan view of a cooling conveyor in accordance with an alternative embodiment of the invention.
Figure 13:
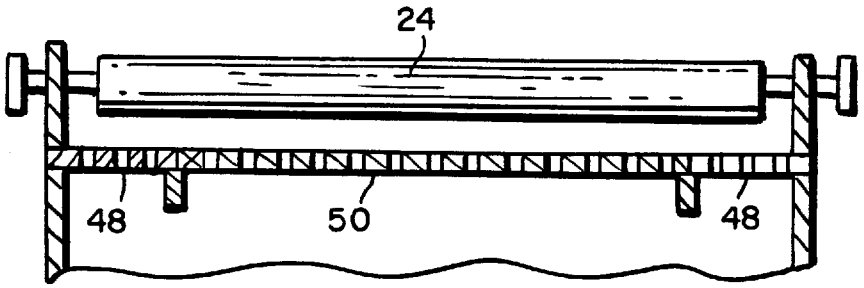
FIG. 13 is a sectional view taken along lines 13—13 of FIG. 12.
Figure 14:
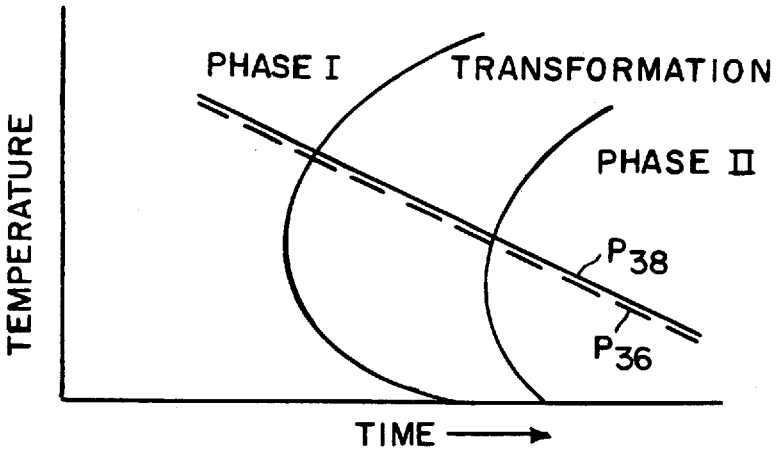
FIG. 14 is a graph depicting the cooling curves of rod segments being processed on the conveyor shown in FIGS. 12 and 13.

In an alternative embodiment of the invention shown in FIGS. 12 and 13, perforated plates 48 and 50 are employed without slots or nozzles in an associated conveyor deck. The edge plates 48 have a greater percentage of open area as compared to that of the central plate 50. As shown in FIG. 14, this arrangement provides essentially identical smooth (as opposed to stepped) cooling paths $P_{36}$, $P_{38}$ for all ring segments.

Figure 15:
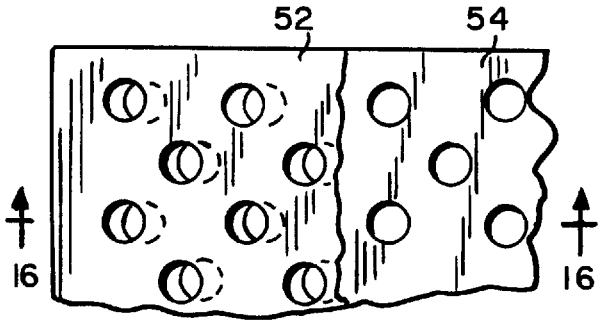
FIG. 15 is a partial plan view of another embodiment of air distribution elements in accordance with the present invention.
Figure 16:
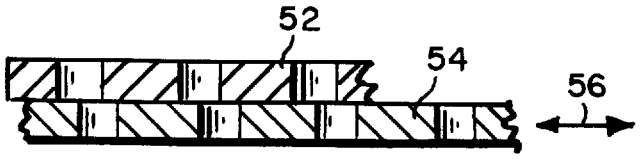
FIG. 16 is a sectional view taken along line 16—16 of FIG. 15.

In another embodiment of the invention, as shown in FIGS. 15 and 16, two superimposed perforated plates 52, 54 may be arranged along the conveyor edge regions 36 and/or the central region 38. One plate 54 can be adjustably reciprocated as indicated by arrow 56 with respect to the other plate 52 to control the volume of air flowing therethrough for application to the overlying ring segments.

The differences in component geometry between the conventional open slots or nozzles of the prior art and the foraminous elements of the present invention produce significant functional improvements. More particularly, air passes through conventional open slots or nozzles in large "macroscopic" volumes, and is highly turbulent and liable to a high degree of non-directionality. With the use of foraminous air distribution elements, i.e., perforated plates, wire meshes and the like, a "microscopic" effect is induced, in effect creating a localized pressure drop, which although very small, is sufficient to ensure that each opening (hole, interstice, etc.) sees a relatively equal amount of air flow. Macroscopic turbulence is broken up and replaced by a multitude of minuscule turbulences which rapidly fade, thereby producing a smoother and more defined air flow perpendicular to the plane of the foraminous element. The coolant volume and velocity changes between the edge and central conveyor regions are also more gradual, thus avoiding the hard transitions which characterize conventional installations.

In light of the foregoing, it will now be apparent to those skilled in the art that various modifications can be made to the disclosed embodiments without departing from the intended scope of the invention as defined by the claims appended hereto. For example, the type and open area of the foraminous air distribution elements can be varied to suit prevailing operation conditions and requirements. The foraminous elements can be located above or below the conveyor deck, and can be supported and/or manipulated by any convenient structure or mechanism. The foraminous elements can be fabricated from any material capable of withstanding exposure to the hot rod, including metal such as steel, copper, etc., and non-metallic materials including ceramics, high temperature plastics, etc., or combinations thereof.

We claim:

1. Apparatus for cooling hot rolled steel rod, comprising:

laying means for forming the rod into a continuous series of rings;

conveyor means for receiving said rings from said laying means and for transporting said rings along a path leading through at least one cooling zone, said rings being arranged on said conveyor means in an overlapping pattern with successive rings being offset one from the other in the direction of said path, and with the ring density of said pattern being greater along edge regions of said conveyor means as compared to the ring density at a central region of said conveyor means;

cooling means operative uniformly across the central and edge regions of said conveyor means for directing a gaseous coolant upwardly through said rings; and foraminous means for retarding the upward flow of said gaseous coolant through said rings along the central region of said conveyor means.

2. The apparatus as claimed in claim 1 wherein said cooling means includes nozzles extending transversely across said path from one edge region across said central region to the other edge region of said conveyor means, said nozzles being arranged above said foraminous means.

3. The apparatus as claimed in claim 1 wherein said foraminous means comprises a perforated plate.

4. The apparatus as claimed in claim 1 wherein said foraminous means comprises a mesh.

5. The apparatus as claimed in claim 1 wherein said foraminous means additionally extends along said edge regions of said conveyor means, the percentage of open area available for flow of said gaseous coolant through said foraminous means being less at said central region than at said edge regions.

6. The apparatus as claimed in claim 5 further comprising adjustment means for adjusting the percentage of open area of said foraminous means.

7. The apparatus as claimed in claim 6 wherein said adjustment means comprises at least two superimposed perforated elements, one of said elements being shiftable relative to the other of said elements.

8. A method of cooling hot rolled steel rod comprising:

forming said rod into a continuous series of rings;

depositing said rings on a conveyor for transport along a path leading through a cooling zone, said rings being arranged on the conveyor in an overlapping pattern with successive rings being offset one from the other in the direction of said path, and with the ring density of said pattern being greater along edge regions of said conveyor as compared to the ring density at a central region of said conveyor;

uniformly directing a gaseous coolant upwardly through said rings from beneath said conveyor at the central and edge regions thereof; and selectively retarding the upward flow of gaseous coolant at the central region of said conveyor by passing said coolant through a foraminous element extending along said central region.

* * * * *